United States Patent [19]

Zehtner

[11] 4,329,825

[45] May 18, 1982

[54] REINFORCING BAR SUPPORT FOR JOINING CONCRETE STRUCTURES

[76] Inventor: Martin P. Zehtner, Eichenstrasse 14, 3074 Muri, near Bern, Switzerland

[21] Appl. No.: 93,190

[22] Filed: Nov. 13, 1979

[30] Foreign Application Priority Data

Dec. 18, 1978 [CH] Switzerland ..... 12820/78

[51] Int. Cl.[3] ..... E04B 1/38

[52] U.S. Cl. ..... 52/698; 52/704; 52/713

[58] Field of Search ..... 52/698, 712, 699, 701, 52/706, 707, 710, 378, 713, 124, 704

[56] References Cited

U.S. PATENT DOCUMENTS

| | | | |
|---|---|---|---|
| 2,780,936 | 2/1957 | Hillberg | 52/699 X |
| 3,159,945 | 12/1964 | La Marte | 52/712 X |
| 3,512,318 | 5/1970 | Turner | 52/699 X |
| 4,010,586 | 3/1977 | Brechbuhler | 52/309.16 |
| 4,073,114 | 2/1978 | Irish | 52/710 |

FOREIGN PATENT DOCUMENTS

| | | | |
|---|---|---|---|
| 2307073 | 3/1974 | Fed. Rep. of Germany . | |
| 2142140 | 2/1973 | France . | |
| 416028 | 1/1967 | Switzerland | 52/699 |
| 562376 | 5/1975 | Switzerland . | |

*Primary Examiner*—Price C. Faw, Jr.
*Assistant Examiner*—Carl D. Friedman
*Attorney, Agent, or Firm*—Saul Jecies

[57] ABSTRACT

A reinforcing bar support for joining concrete structures, having a hollow body of prismatic shape and formed by a front part and by a cover part. The front part features a front side scheduled to be installed in the concreted main wall, two longitudinal narrow sides and two cross sides. The sides are so designed that the cover part can be clamped to the front part and released therefrom. The front side is provided with a longitudinal center groove and equidistant cross grooves, with the cross grooves used for marking holes to be drilled later, which holes are scheduled to receive the leg ends of the reinforcing bars.

3 Claims, 5 Drawing Figures

REINFORCING BAR SUPPORT FOR JOINING CONCRETE STRUCTURES

Figure 1:
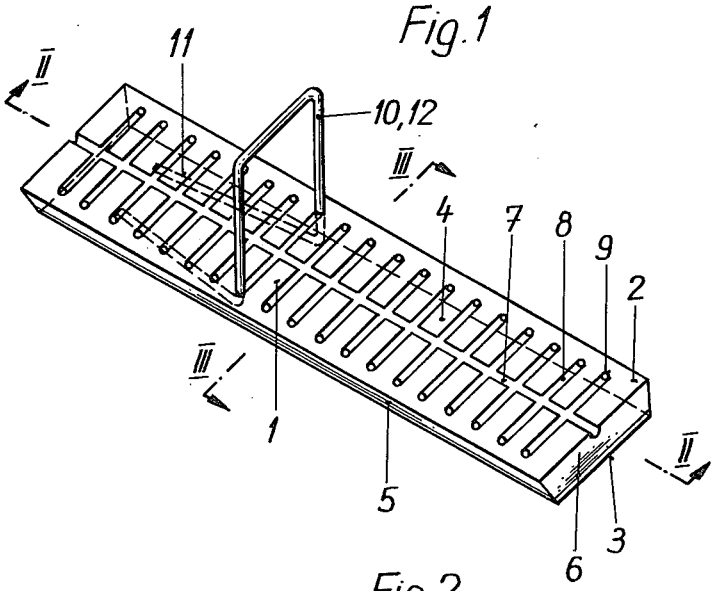

The invention concerns a reinforcing bar support for joining concrete structures.

The rational erection of concrete walls is effected by means of shuttering. A drawback in this connection is that the main walls must be cut out for joining partitions, stairs, intermediate floors, etc.. This is a difficult, time-consuming and relatively expensive job.

Processes and devices for applying these processes have already been published, notably for joining vertical partitions. DE-AS2,307,073 makes public a system for flashing wall joining bars. The flashing component consists of a long flashing back, of a corresponding flashing front with recesses for the wall joining bars bent off in an angular shape and which protrude in their installed position with one leg from the recesses, with the other leg from wall joining bars arranged between the flashing front and the flashing back, and spacer ridges between the flashing front and the flashing back. The flashing back, the flashing front and the spacer ridges are made of an elastic workable material and the recesses in the flashing front are elastic, too.

This known flashing component has the advantage that for clearing the end sections used for joining, it can be withdrawn as a whole in the direction of the end sections located between the flashing front and back, which saves considerable time. It is, however, quite expensive and its scope of application is limited.

FR-PS 2,142,140 has made public a process with a system for supporting joining bars when concreting a wall, wherein the joining bars feature a U-shaped stirrup in the horizontal plane which will be installed in the wall to be concreted. The two legs of the reinforcing bars protrude through the vertical system shaped as a trapezoid tray and after the passage holes in the tray they are bent off perpendicular to the plane determined by the U-shaped stirrup, so that the leg ends are resting close to the tray. The bent-off reinforcing bars are bent up to the U plane for joining a wing wall so that the tray can be removed from the wall in the direction of these reinforcing bars.

CH-PS 562,376 has already proposed a process for making reinforcing parts as well as a support for reinforcing bars made according to this process. The reinforcing bars are embedded in a trapezoid form made of cast foam material. After the reinforcing bars are set in concrete, the foam material is scraped off so that a dove-tailed rabbet appears for joining a partition.

This invention represents an improvement for setting such reinforcing bars in concrete, with the possibility of making the supporting component for the reinforcing bars inexpensively by series production and of shipping such components in space-saving shipments, of reducing reinforcing bar anchoring work and of removing the supporting component easier after the concreting.

The drawing shows, by way of example, one embodiment of the object of the invention.

Figure 2:
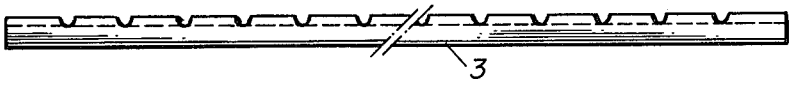
Figure 3:
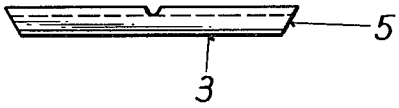
Figure 4:
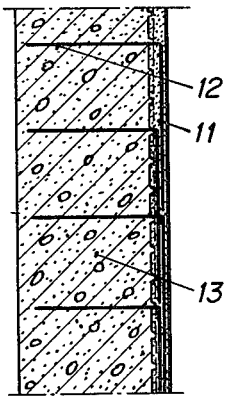
Figure 5:
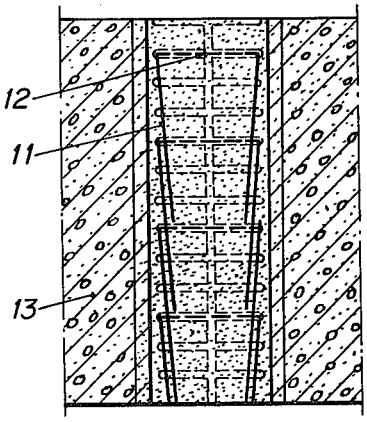

FIG. 1 shows a reinforcing bar support made of plastic material according to a perspective view, FIG. 2 shows a sectional view according to line II—II in FIG. 1, FIG. 3 shows a sectional view according to line III—III in FIG. 1, FIG. 4 shows a sectional view through a concreted main wall where the shuttering is removed, and FIG. 5 shows a view of the reinforcing bar support after the concreting, with the reinforcing bar support open.

The reinforcing bar support shown features a hollow body 1 of prismatic shape. It is formed by a front part 2 and a cover part 3. The front part 2 has a front side 4, two longitudinal narrow sides 5 and two cross sides 6 (FIG. 1). These sides 5, 6 are held rigid and they are designed in such a manner that the cover part 3 can be clamped thereto and released therefrom. The front side 4 of the front part 2 is provided with an inwards-pointed longitudinal center groove 7 and with equidistant cross grooves 8 which are perpendicular to said center groove. The cross grooves serve for marking holes 9 scheduled to be drilled subsequently, the distance of which can be measured advantageously from the longitudinal center groove 7. The grooves 7, 8 improve, in addition, the concrete connection. The holes 9 are used for hooking in the two free bent-off leg ends 11 of reinforcing bars 10. The latter feature a U-shaped stirrup 12 and the leg ends 11 are resting in a plane that is perpendicular to the U plane of the stirrup 12 and they are bent off in such a manner that they are mutually converging. The leg ends 11 are resting close to the front side 4 of the front part 2. The stirrup 12 protrudes from the hollow body 1 so that it will be set in concrete in the main wall 13 (FIG.4). The hooking in of the leg ends 11 is effected advantageously with the cover part 3 removed. The cover part 3 is secured to the front part 2 after the reinforcing bars 10 are hooked in. The hollow body 1 is set in concrete in the main wall 13 with the stirrups 12, with the cover part 3 resting against the shuttering.

The reinforcing bar support shown in the drawing is made of plastic material that is as anti-adhesive as possible, e.g. polyvinyl, polyvinylchloride or polyethylene, and it features a trapezoid cross section (FIG. 3). This produces a dove-tailed anchoring of the concrete partition. The hollow body 1 can be easily removed from the main concrete wall 13. Prior to the joining concreting, the leg ends 11 are bent up into the stirrup plane.

In view of multiple use, the hollow body 1 may be made of metal such as aluminium and provided with a rectangular cross section.

The cover part 3 also allows for shipping reinforcing bars 10.

I claim:

1. An article of manufacture, comprising a reinforcing bar support in the form of a elongated hollow body of a material having the characteristic of being anti-adhesive to concrete;

said hollow body having a front part; and four depending sides;

said front part having formed therein grooves transverse to its length and spaced from each other at predetermined intervals to facilitate drilling of apertures to be made in said front part for the insertion of reinforcing bars;

a pair of spaced apart apertures formed in said grooves;

a U-shaped reinforcing bar inserted into said pair of apertures, the legs of said reinforcing bar being bent to extend parallel to said front part; and a removable cover part adapted to be placed over said sides to space said front part from the shuttering of a concrete form.

2. An article of manufacture as defined in claim 1, wherein said front part and said cover part are of substantially identical width and said hollow body is of substantially rectangular cross-section.

3. An article of manufacture as defined in claim 1, wherein said front part and said cover part are of different widths, said cover part being of greater width and said hollow body being substantially of prismatic cross-section.

* * * * *